US005209633A

United States Patent [19]

McGreehan et al.

[11] Patent Number: 5,209,633

[45] Date of Patent: May 11, 1993

[54] HIGH PRESSURE COMPRESSOR FLOWPATH BLEED VALVE EXTRACTION SLOT

[75] Inventors: William F. McGreehan, West Chester; Bradley W. Fintel, Fairfield; Andrew J. Lammas, Maineville, all of Ohio

[73] Assignee: General Electric Company, Cincinnati, Ohio

[21] Appl. No.: 839,275

[22] Filed: Feb. 25, 1992

Related U.S. Application Data

[63] Continuation of Ser. No. 615,676, Nov. 19, 1990, abandoned.

[51] Int. Cl.[5] ..... F01D 17/00

[52] U.S. Cl. ..... 415/144; 415/169.1

[58] Field of Search ..... 415/169.1, 144, 145

[56] References Cited

U.S. PATENT DOCUMENTS

| | | | |
|---|---|---|---|
| 2,520,697 | 8/1950 | Smith | 415/144 |
| 3,108,767 | 10/1963 | Eltis et al. | 244/42 |
| 3,142,438 | 7/1964 | McKenzie | 415/144 |
| 3,309,867 | 3/1967 | Ehrich | 415/208.2 |
| 3,362,155 | 1/1968 | Driscoll | 415/169.1 |
| 3,777,489 | 12/1973 | Johnson et al. | 60/226 R |
| 3,898,799 | 8/1975 | Pollert et al. | 60/266 R |
| 3,966,355 | 6/1976 | Pierpoline | 415/169.1 |
| 4,344,282 | 8/1982 | Anders | 60/226 R |
| 4,711,084 | 12/1987 | Brockett | 60/39.07 |
| 4,827,713 | 5/1989 | Peterson et al. | 60/226.1 |
| 4,844,689 | 7/1989 | Seed | 415/169.1 |
| 5,044,153 | 9/1991 | Mouton | 60/39.093 |

FOREIGN PATENT DOCUMENTS

| | | | |
|---|---|---|---|
| 0374004 | 6/1990 | European Pat. Off. . | |
| 1012339 | 7/1952 | France | 415/144 |
| 1082974 | 3/1984 | U.S.S.R. | 415/144 |

*Primary Examiner*—John T. Kwon

*Attorney, Agent, or Firm*—John R. Rafter; Jerome C. Squillaro

[57] ABSTRACT

A high pressure compressor flowpath bleed extraction slot is provided wherein an articulated portion of the outer band of the compressor forms a slot for providing efficient conversion of core air to diffuser air while retaining substantial pressure and velocity energies. The diffuser slot can be applied to an earlier compressor stage with improved performance.

1 Claim, 3 Drawing Sheets

HIGH PRESSURE COMPRESSOR FLOWPATH BLEED VALVE EXTRACTION SLOT

This application is a continuation of application Ser. No. 07/615,676, filed Nov. 19, 1990, now abandoned.

This invention relates to simplified bleed extraction slots for gas turbine engines and, more particularly, to a specially configured bleed extraction slot for efficiently converting core air to bleed air with a minimum loss in bleed air velocity pressure.

BACKGROUND OF THE INVENTION

It is often desirable that an aircraft gas turbine engine include within its compressor, a structure which permits bleeding or diversion of high pressure air from a stage, such as the 5th stage of the compressor to provide high pressure air for cooling purposes and for operation of airframe accessories, engine accessories, or engine or aircraft de-icing systems. In other cases, it is desirable to include a structure which permits the bleeding of even higher pressure air from the discharge of the compressor to provide pressurized air for cooling downstream turbine components. Both interstage bleed and the compressor discharge bleeding are accomplished by flowpath mechanisms which interfere with the normal airflow patterns in the compressor. Further, the casing or bleed structure adds complexity to the assembly of such an engine.

The axial location or stage at which air is bled from the compressor is determined by the pressure required to drive the specific system intended to be serviced by that air. In most instances, it is desirable to achieve the highest possible source pressure to also ensure a high delivery pressure. For this reason, prior systems have extracted air from the latter stages of the compressor and more particularly, engines having these systems have been designed to extract high pressure air from the 5th stage of the compressor for low pressure turbine cooling and turbine thermal clearance control. However, bleeding air from the earliest possible stage of the compressor generally increases compressor efficiency by reducing the amount of work invested in the extracted air. Therefore, it is desirable to achieve the highest possible system supply pressure from the earliest and lowest pressure stage of the compressor. The resulting temperature of the cooling air is also lower and hence more effective.

Known examples of bleed openings or ports can be found in U.S. Pat. No. 4,711,084 to Brockett for an ejector-assisted compressor bleed which discloses a bleed aperture 17 in FIG. 2 having rounded hole edges. U.S. Pat. No. 3,108,767 to Eltis, et al., for a bypass gas turbine engine with an air bleed means in FIG. 3 discloses a duct 19 which is attached to the compressor through a series of chopped holes. U.S. Pat. No. 3,898,799 to Pollert, et al., for a device for bleeding off compressor air in a turbine jet engine, in FIG. 2 discloses a compressor orifice marked with the arrow K. U.S. Pat. No. 3,777,489 to Johnston, et al., discloses a combustor casing having a concentric air bleed structure which includes a series of conical arms 62, 64, and 66 situated in the low velocity area of the diffuser with the bled air structure making a turn of approximately 180°. U.S. Pat. No. 4,344,282 to Anders is directed to a compressor bleed system which includes a locking strap 12 which seals a series of bleed ports 8. U.S. Pat. No. 4,827,713 to Peterson, et al., for a stator valve assembly for rotory machine which includes a passage 30 in the compressor bleed system 28. The structure disclosed in each of these patents significantly reduces the pressure or velocity of the extracted air and thus reduces the energy level of the diffuser air. These documents fail to teach or suggest a pressure efficient diffuser slot which maintains the energy and pressure level of the diffused air to allow the extraction of air from an earlier compressor stage yet having a pressure and energy level equivalent to air previously extracted from a later stage.

SUMMARY OF THE INVENTION

It is therefore desirable to provide a bleed air structure capable of efficiently extracting compressor discharge air with a minimum energy loss and delivering the extracted air to external systems with little pressure loss and at as high a pressure as possible.

Briefly stated, the above and similarly related objects are obtained by providing a gas turbine engine which includes an axial flow, multistage compressor, a combustor, and a turbine. A high pressure compressor bleed air extraction slot structure is provided comprising a compressor outer band having a bleed air portion positioned proximate a rearward and preferably interstage section of a compressor. A diffusing slot can be disposed in the compressor outer casing and can comprise an articulated or punched-out portion of the outer band articulated at an angle approximately 10–20 degrees from a band baseline whereby the discharge coefficient of the bleed valve is improved. In a preferred embodiment, the articulated angle is 15 degrees and the exit velocity V2 is less than the baseline velocity V1 while the exit pressure P2 is greater than the baseline pressure P1.

BRIEF DESCRIPTION OF THE DRAWINGS

While the specification concludes with a series of claims which particularly point out and distinctly claim the subject matter which applicants consider to be their invention, a more complete understanding of the invention will be gained from the following detailed description which is given in connection with the accompanying drawings, in which

DETAILED DESCRIPTION OF THE DRAWINGS

Figure 1:
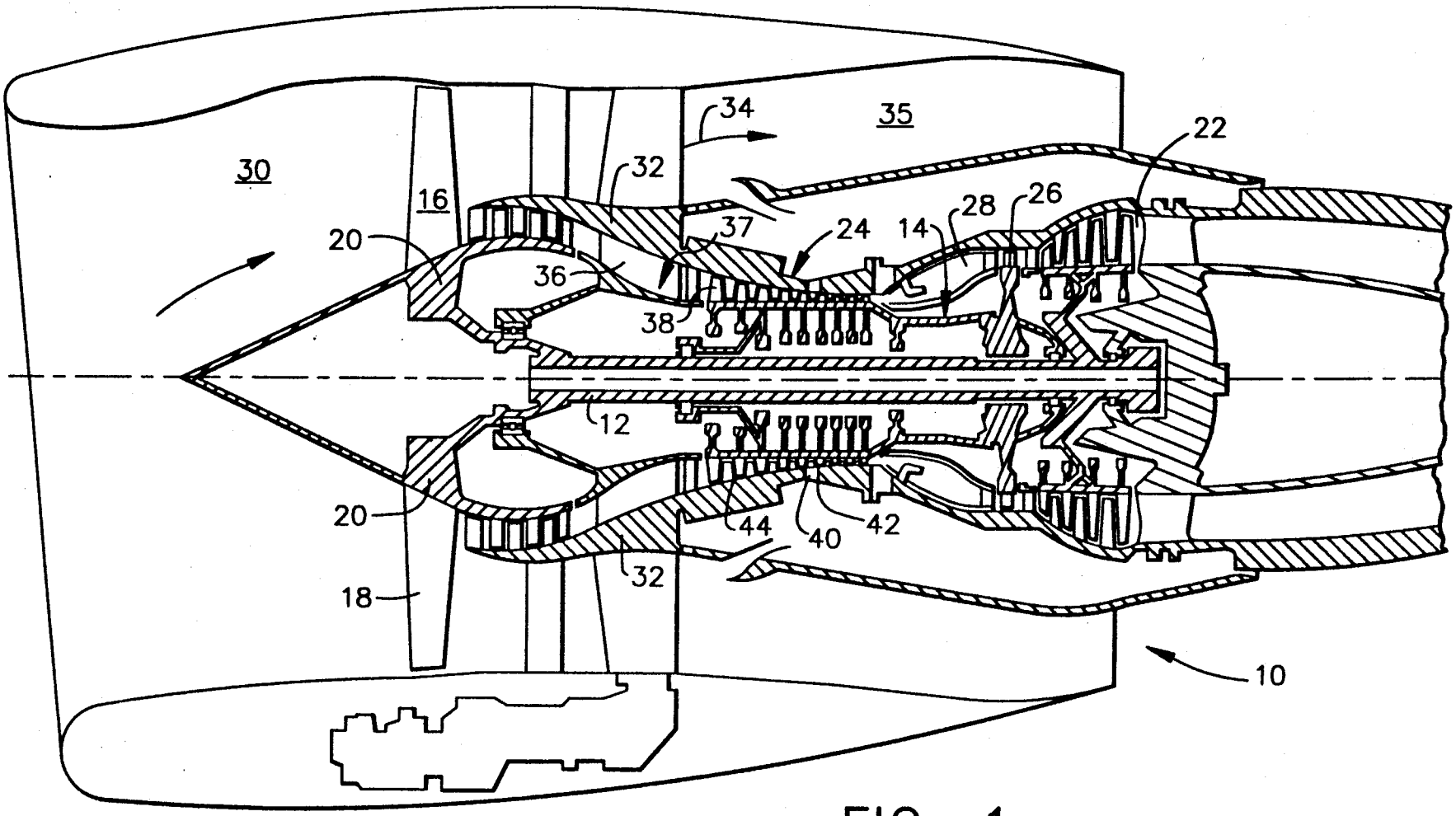
FIG. 1 (PRIOR ART)
FIG. 1 is a greatly simplified schematic view taken in cross section of a turbofan engine having a previously proposed bleed valve.

Referring to the drawings wherein the numerals correspond to like elements throughout, attention is directed initially to FIG. 1 wherein a gas turbine engine 10 is shown in major cross section to include a fan rotor 12, and a core engine rotor 14. The fan rotor 12 includes a plurality of fan blades 16 mounted for rotation on a disk 20. The fan rotor 12 also includes a low pressure or fan turbine 22 which drives the fan disk 20 in a well known manner. The core engine rotor 14 includes a compressor 24 and a high power or high pressure turbine 26 which drives the compressor 24. The core engine also includes a combustion system 28.

In operation, air enters the gas turbine 10 through an inlet 30 provided by means of a suitable cowling 32 which surrounds the fan rotor 12 and core engine rotor 14 and provides the external casing for the engine. Air entering the inlet 30 is compressed by means of the rotation of fan blades 16 and thereafter is split into two flow streams, a bypass stream 34 flowing in a bypass passageway 35, and a core engine stream 36 flowing in a core passageway 37.

The pressurized air which enters the core engine passageway 37 is further pressurized by means of the compressor 24 and is thereafter mixed and ignited along with high energy fuel in the combustion system 28. This highly energized gas stream then flows through the high pressure turbine 26 to drive the compressor 24 and thereafter through the low pressure turbine 22 to drive the fan rotor 12 and disk 20. The pressurized air flowing through the bypass passageway 35 is either mixed with the core engine exhaust system stream by means of a suitable mixer (not shown) or is allowed to exhaust to ambient conditions as a relatively low velocity, low pressure stream surrounding the core engine exhaust. In either case, the core engine stream 36 exhaust and fan bypass stream 34 exhaust provide a propulsive force for an aircraft powered by the turbofan engine 10.

It should be noted that although the present description is limited to an aircraft gas turbine engine, the present invention may be applicable to any gas turbine engine powerplant such as those utilized for marine or industrial usage. A description of the engine shown in FIG. 1 is thus merely illustrative of the type of engine to which the present invention is applicable.

Figure 3A:
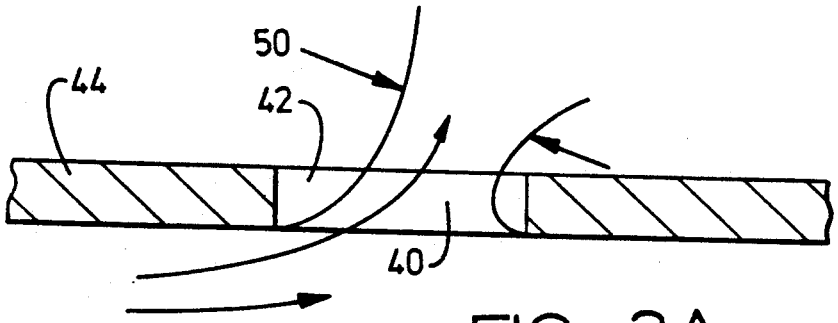
FIGS. 3*a* and 3*b* are enlarged schematic illustrations of typical bleed valves in accordance with FIGS. 1 and 2, respectively, illustrating the theoretical airflows associated therewith.

As shown in FIGS. 1 and 3A, a diffusing port or hole 40 comprises an orifice 42 located in line with an outer band 44 of the engine cowling or casing 32. The compressor casing structure 44 provides an annular orifice 42 immediately upstream of one of the intermediate stages of the rotor blades 38 for bleeding interstage air from the interior of the compressor 24.

Figure 2:
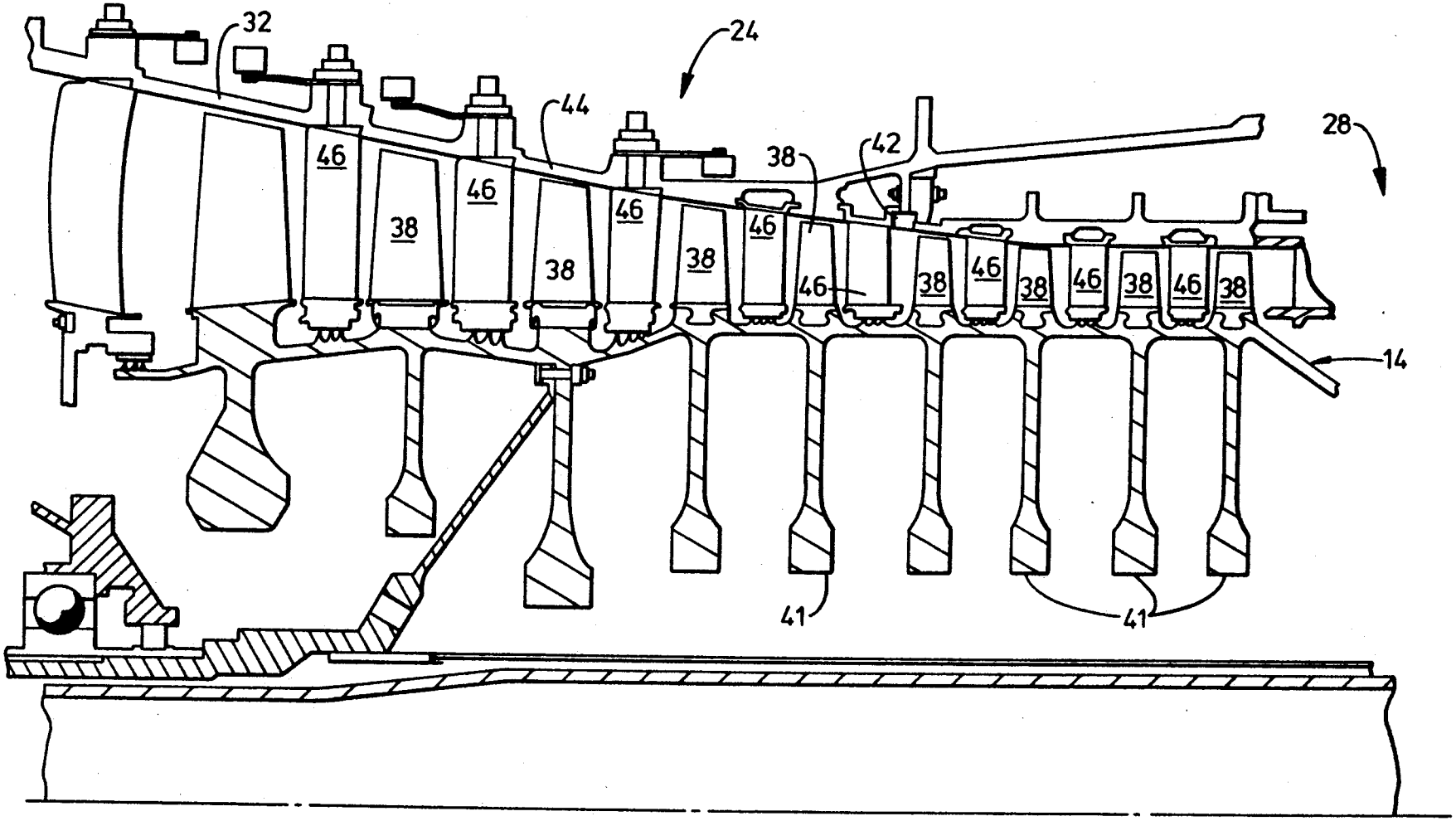
FIG. 2 is a greatly simplified schematic view taken partially in section of a turbofan engine incorporating a bleed valve in accordance with the present invention.
Figure 3B:
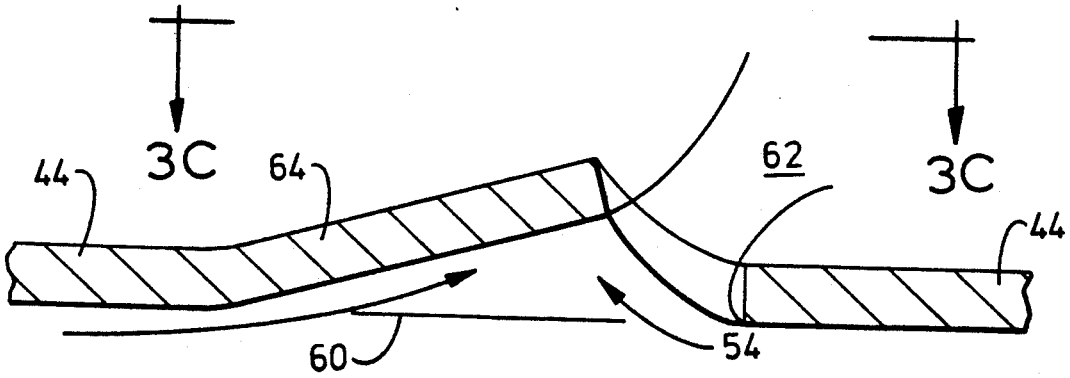

Referring now to FIGS. 2 and 3B, the details of the inventive diffusion slot and bleed air structure in accordance with the present invention are shown in an enlarged cross-sectional view of the compressor 24. As shown therein, the compressor 24 includes a rotor 14 having a number of rotor stages 41 which carry a plurality of rotor blades 38. The compressor 24 further includes a casing structure 32 which defines the outer bounds of the compressor flowpath and includes mounting provisions for a plurality of stator vanes 46 aligned in individual stages between each stage of rotor blades 38.

Figure 3C:
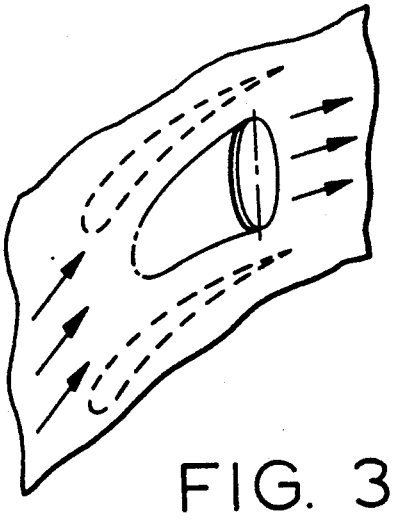
FIG. 3*c* is a schematic illustration of the location of the bleed valve of FIG. 3*b* within the compressor outer casing, illustrating the theoretical airflow through the bleed valve.

In accordance with a preferred embodiment, shown in FIGS. 3B and 3C, the outer band 44 includes a diffuser slot 62 comprising a punched-out and articulated portion 64 articulated at an angle of between 10 and 20 degrees and preferably 15 degrees measured from a baseline 60 of the outer band 44.

Referring now to FIGS. 3A and 3B in combination, a comparison of the prior annular 5th stage orifice 42 is shown in FIG. 3A in relation to the present articulated 4th stage diffuser slot 62 in accordance with the present invention, shown in FIG. 3B. More particularly, as illustrated in FIG. 3A, the annular orifice 42 induces a swirling airflow 50 which substantially restricts the opening of orifice 42 and reduces the discharge coefficient $C_d$ associated with the orifice. Moreover, the annular orifice 42 requires the exiting air to alter its velocity by approximately 90 degrees with a concommitant energy reduction.

In contrast, a diffusing slot 62 in accordance with the present invention, which is shown in FIG. 3B, includes an articulate portion 64 which expands the volume of a lateral cavity 54 of the compressor vane to cause the cavity to immediately capture diffuser air and minimally change the velocity and energy level of the captured air. The volume of the lateral cavity 54 is considered to be the volume between the casing baseline 60 and the articulated member 64. As is illustrated, the swirl pattern established by this slot 62 occurs closely adjacent the slot's surfaces 44 and 64 and thus introduces a minimal obstruction to the air flowpath. Accordingly, the pressure drop associated with the slot 62 is minimized, the discharge coefficient, $C_d$, associated with this slot is maximized and the energy level of air passing through the diffuser is maintained. The efficient energy conversion achieved by this slot produces air at a higher pressure than that previously achieved. Accordingly, the slot 62 can be applied to an earlier or lower pressure stage of the compressor and yet still supply air of a pressure equivalent to that previously derived from a later stage. The bleed slot 62 of the present invention provides a means to recover and convert a portion of the gas stream dynamic pressure into a manifold static pressure rise. The angled recessed surface of the articulated portion 64 acts as a diffuser to decelerate the air as it passes through the outer band opening thereby reducing the irreversible losses in energy.

The discharge coefficient $C_d$ is defined as the ratio of actual mass flow to ideal mass flow through a restriction and can be expressed by the equation $C_d = M1/M2$. The invention can be characterized based on test data which shows clearly that a higher $C_d$ is achieved for the diffusing slot 62 compared to a standard orifice 42 each having the same cross-sectional area. More particularly, in a typical 9-stage compressor, the prior orifice 42 when applied to the 5th stage could achieve a discharge pressure of 132 psia 16 f/in$^2$ at temperature of 1207° R. (Rankine). In contrast, the present invention, when applied to the 4th stage of the same compressor, can achieve a discharge pressure of 118 psia at temperature of 1089° R.; thus, improving the efficiency of the engine.

Accordingly, the diffuser extraction slot 62 of the present invention allows a portion of the gas flowpath velocity pressure to be recovered as usable manifold static pressure. This higher pressurized flow allows the bleed extraction point to be relocated at least one stage forward in the compressor and represents an overall increase in efficiency and engine performance which can be reflected in lower specific fuel consumption. In addition, the extraction of air earlier in the compressor provides a lower temperature source for turbine cooling systems.

Although the invention has been shown and described in detail with respect to the preferred embodiments thereof, it should be recognized by those skilled in the art that various changes in the form and detail thereof may be made without departing from the true spirit and scope of the present invention. Accordingly, the size and location of the diffuser slot can be changed to reflect the pressure drop and flow requirements of the system(s) that the bleed slots supplies. Further, the shape of the orifice can be changed such that the pressure gradient across the opening can be minimized to insure a high pressure flow. Accordingly, the bleed diffuser slot construction of the present invention can be adapted to fit a number of gas turbine engines as described herein.

It will be readily understood by those skilled in the art that the present invention is not limited to the specific embodiments described and illustrated herein. Different embodiments and adaptations besides those shown herein and described, as well as many variations, modifications and equivalent arrangements will now be apparent or will be reasonably suggested by the foregoing specification and drawings, without departing from the substance or scope of the invention. While the present invention has been described herein in detail in relation to its preferred embodiments, it is to be understood that this disclosure is only illustrative and exemplary of the present invention and is made merely for purposes of providing a full and enabling disclosure of the invention. Accordingly, it is intended that the invention be limited only by the spirit and scope of the claims appended hereto.

What is claimed is:

1. An energy efficient compressor air bleed structure for use in an axial flow compressor including a compressor casing having an outer band, said air bleed structure comprising:

a) a means for recovering and converting a portion of a gas stream dynamic pressure into a manifold static pressure rise;

b) wherein said means for recovering and converting comprises an articulated diffuser slot including an articulated portion of said compressor casing outer band; and c) wherein said articulated portion i) is articulated at an angle of approximately 10–20 degrees from a compressor casing outer band baseline, and ii) includes an angled recessed surface which acts as a diffuser to decelerate bleed air as it passes through said articulated diffuser slot, and wherein said articulated portion comprises a punched-out portion of said compressor casing outer band.

* * * * *